US008166903B1

(12) United States Patent
Demmelmaier et al.

(10) Patent No.: US 8,166,903 B1
(45) Date of Patent: May 1, 2012

(54) DEADRISE-ALTERING ADJUNCT FOR MARINE HULL BOTTOM

(75) Inventors: Allan W. Demmelmaier, Virginia Beach, VA (US); Donald R. Jacobson, Virginia Beach, VA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 286 days.

(21) Appl. No.: 12/456,268

(22) Filed: Jun. 8, 2009

(51) Int. Cl.

| | |
|---|---|
| ***B63B 1/00*** | (2006.01) |
| ***B63B 3/08*** | (2006.01) |
| ***B63B 3/10*** | (2006.01) |
| ***B63B 17/00*** | (2006.01) |
| ***B63B 59/02*** | (2006.01) |
| ***B63G 9/02*** | (2006.01) |

(52) U.S. Cl. ..... 114/271; 114/14; 114/219; 114/343; 114/361

(58) Field of Classification Search ..... 114/219, 114/343, 361, 9–14, 240 R, 271
See application file for complete search history.

(56) References Cited

U.S. PATENT DOCUMENTS

| | | | | | |
|---|---|---|---|---|---|
| 372,761 | A | * | 11/1887 | Palmer | 114/9 |
| 656,001 | A | * | 8/1900 | Walsh | 114/9 |
| 1,319,480 | A | * | 10/1919 | Magnuson | 114/9 |
| 1,354,671 | A | * | 10/1920 | Magnuson | 114/13 |
| 3,190,587 | A | * | 6/1965 | Fries | 244/106 |
| 3,220,026 | A | | 11/1965 | Lichti | |
| 3,459,147 | A | * | 8/1969 | Ismay | 114/67 R |
| 3,559,222 | A | * | 2/1971 | Walker | 114/357 |
| 3,680,516 | A | * | 8/1972 | Loverdos-Stelakatos | 114/67 R |
| 4,058,077 | A | | 11/1977 | Johansson | |
| 4,236,474 | A | | 12/1980 | Buirski et al. | |
| 4,474,131 | A | | 10/1984 | Buirski et al. | |
| 4,858,550 | A | | 8/1989 | Bellia | |
| 4,909,172 | A | | 3/1990 | Hamby | |
| 4,962,719 | A | | 10/1990 | Hughes et al. | |
| 4,972,791 | A | | 11/1990 | Williams | |
| 5,224,436 | A | | 7/1993 | Stricker | |
| 5,357,890 | A | | 10/1994 | Mason, Jr. et al. | |
| 5,685,253 | A | | 11/1997 | Alexander, Jr. | |
| 5,803,010 | A | * | 9/1998 | Roy et al. | 114/343 |
| 6,038,995 | A | | 3/2000 | Karafiath et al. | |

(Continued)

OTHER PUBLICATIONS

Wing Inflatables product advertisement, Work Boat magazine, Jun. 2009, vol. 66, No. 6, p. 59.

*Primary Examiner* — Ajay Vasudeva
(74) *Attorney, Agent, or Firm* — Howard Kaiser

(57) ABSTRACT

As typically embodied, the present invention's add-on device includes two wedge-shaped structural components that are oppositely congruent and symmetrically connected. In profile, the device describes a pair of nearly triangular quadrilateral figures that are enantiomorphs (mirror images) with respect to the linear bisector (mirror line) at which they join. The device's V-angular upper surface defines the same V-angularity ("deadrise") as does a V-angular hull bottom, the device thus fitting beneath the hull bottom. The device's V-angular lower surface defines a different angularity, which is imparted to the hull bottom when the device is attached thereto. According to typical inventive practice, the device alters the hull bottom's V-angularity by at least 1° and, at least, covers approximately 100% of the hull bottom's widthwise expanse along approximately 50% or more of the hull bottom's lengthwise expanse. The device modifies a marine vessel's hydrodynamics and/or hydrostatics, and may provide armor and/or wear benefits.

23 Claims, 12 Drawing Sheets

U.S. PATENT DOCUMENTS

| | | | |
|---|---|---|---|
| 6,138,601 | A | 10/2000 | Anderson et al. |
| 6,158,376 | A | 12/2000 | Vorus |
| 6,223,674 | B1 | 5/2001 | Wyman et al. |
| 6,223,677 | B1 | 5/2001 | Hall et al. |
| 6,460,477 | B1 | 10/2002 | Hamilton et al. |
| 6,588,360 | B1 | 7/2003 | Bachmann |
| 6,698,370 | B1 | 3/2004 | Cusanelli |
| 6,805,067 | B1 | 10/2004 | Cusanelli |
| 7,140,318 | B1 | 11/2006 | Gasper |
| 7,225,752 | B2 | 6/2007 | Schulz |
| 2004/0240944 | A1 | 12/2004 | Kelly |
| 2006/0086302 | A1 | 4/2006 | Gerstenberger |
| 2006/0137591 | A1 | 6/2006 | Loui et al. |
| 2007/0012234 | A1 | 1/2007 | Askew |
| 2007/0012235 | A1 | 1/2007 | Askew |
| 2007/0245944 | A1 | 10/2007 | Scism et al. |

* cited by examiner 100
110p
120, 121p
v
α
α
W
h
120, 121s
110s 100
130
v
120, 121p
110p
140
120, 121s
110s
W
L 100
s
110s
120, 121s $0 < \beta < \alpha$

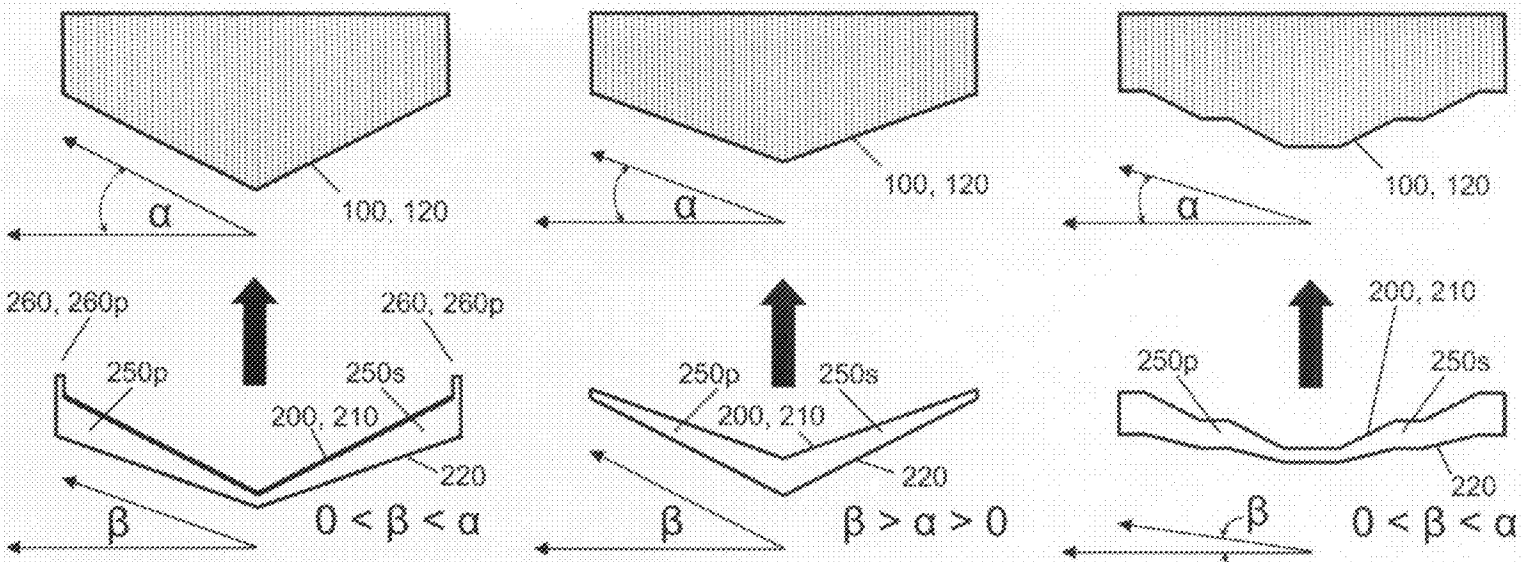
FIG. 13
FIG. 15
FIG. 17
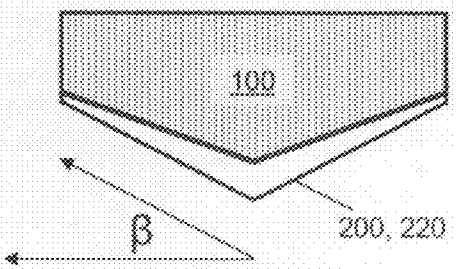
FIG. 14
FIG. 16
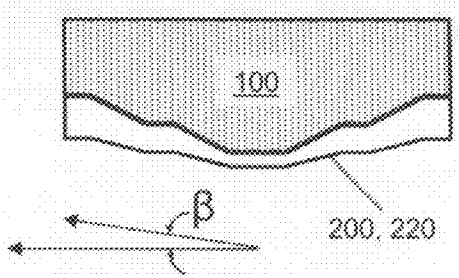
FIG. 18

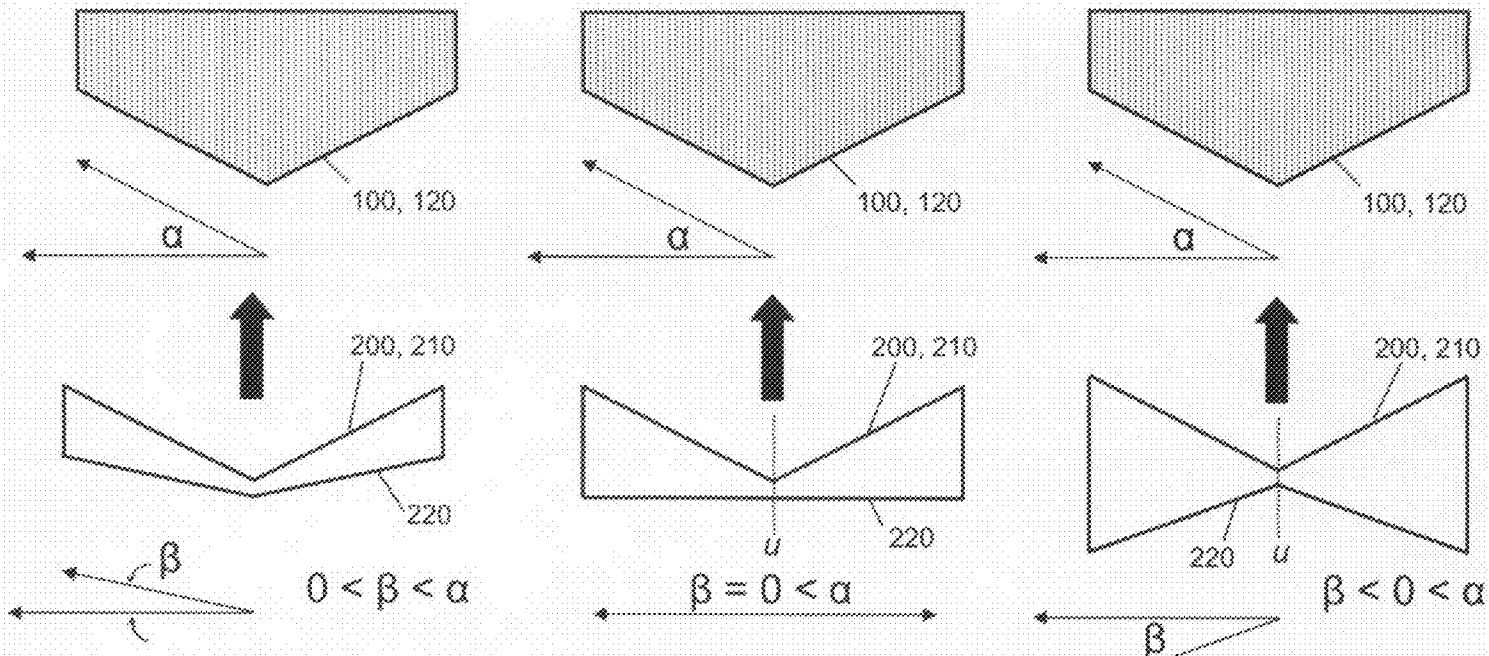
FIG. 19
FIG. 21
FIG. 23
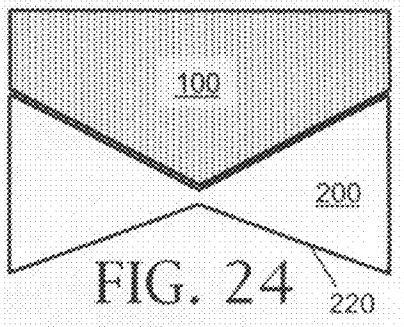
FIG. 20
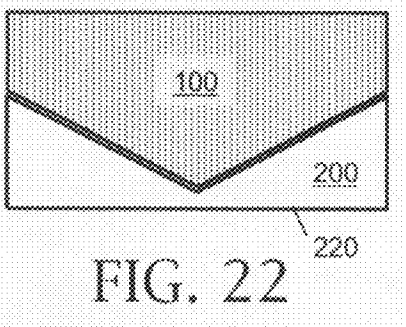
FIG. 22
FIG. 24

100, 120
α
200, 210
β
220
β > α < 0

100, 120
α
200, 210
220
u
β = 0 > α

100, 120
α
200, 210
220
v
β > 0 > α

100
200
220

100
200
220

100
200
220

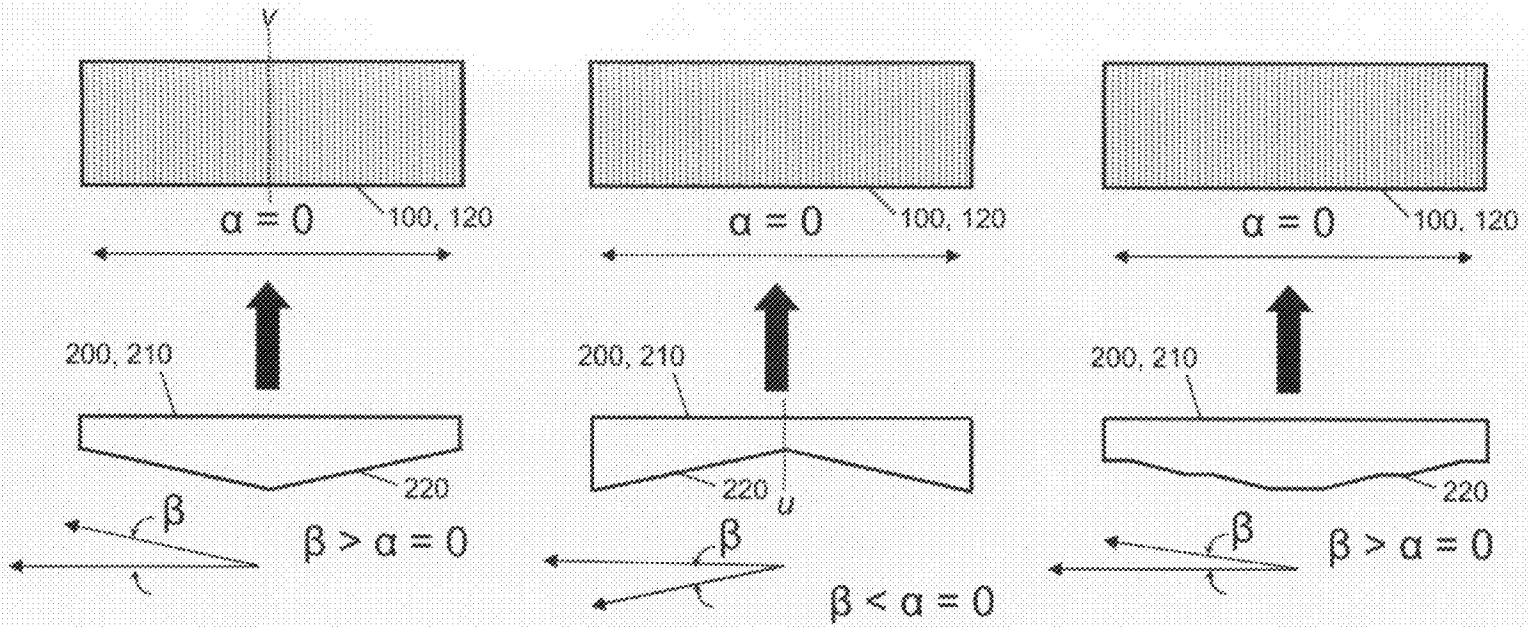
FIG. 31
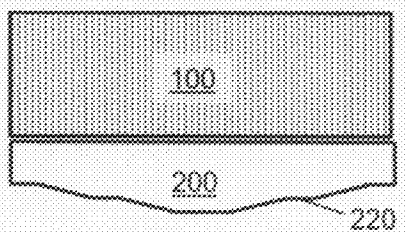
FIG. 32
FIG. 33
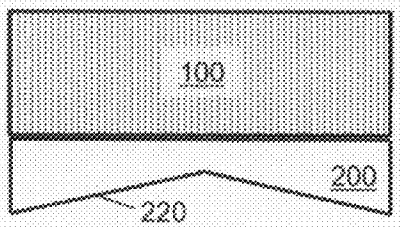
FIG. 34
FIG. 35
FIG. 36

DEADRISE-ALTERING ADJUNCT FOR MARINE HULL BOTTOM

BACKGROUND OF THE INVENTION

The present invention relates to marine vessels, more particularly to devices designed to be attached to a marine vessel in order to affect the hydrodynamics and/or hydrostatics of the marine vessel.

It is not uncommon for a vehicle such as a marine vessel to be designed for a particular use and at some point be needed for a different use. This kind of situation is seen, for instance, when a military entity purchases a small craft for one mission, but needs to use that craft for another mission. The craft is suitable for its original mission, but is unsuitable or less suitable for its new mission, since the latter imposes requirements that were not taken into consideration in the original design of the craft.

For example, a craft designed to operate at a certain displacement may be subjected to loads much heavier than design loads, due to added equipment or armor. As another example, a craft may be designed for waters (e.g., in waves at sea) requiring a deeper draft and/or more fine entry, but is subsequently needed for waters (e.g., in rivers) requiring a shallower draft and/or less fine entry. Other examples of unforeseen circumstances include greater susceptibility to enemy attack (such as via waterborne explosive mines or IEDs), and greater exposure to damage or wear (such as via rough, shrubby, or rocky underwater terrain).

Accordingly, during its lifecycle a craft may encounter changed circumstances that render the craft less than optimal in terms of stability, structure, resistance, hydrodynamics, hydrostatics, and/or operation. Such shortcomings may be difficult or unfeasible to correct within the bounds of the existing craft. The determination of causes of and solutions to particular issues besetting the existing craft may prove to be even more costly than obtaining a new craft, usually an expensive and time-consuming proposition. It is therefore desirable to find practical ways to effect or facilitate adaptation of existing watercraft to emerging requirements.

SUMMARY OF THE INVENTION

In view of the foregoing, an object of the present invention is to provide method and apparatus for adapting a marine vessel to changed requirements.

Another object of the present invention is to provide such method and apparatus that are efficient and economical.

An inventive apparatus, as typically embodied, includes a double-wedge-shaped adjunct for a marine hull. The hull has a V-angular hull bottom that is characterized by a first deadrise angle, a hull bottom length, and a hull bottom width. The inventive adjunct has a V-angular upper adjunct surface and a V-angular lower adjunct surface. The inventive adjunct's upper adjunct surface is conformal with the hull bottom to permit flush attachment of the inventive adjunct underneath at least a portion of the hull bottom, whereby the inventive adjunct is coextensive with at least approximately half the hull bottom length and, at least in part, is coextensive with approximately the entire hull width for at least approximately half the hull bottom length. The hull bottom is changed by the flush attachment so as to be characterized by a second deadrise angle, which differs from the first deadrise angle.

Inventive practice allows for wide dimensional ranges and multifarious configurations. Generally speaking, an inventive adjunct will extend across at least a portion of the hull bottom's width, and will extend along at least a portion of the hull bottom's length. An inventive adjunct can be embodied so that its adjunctive width is constant along its adjunctive length, or so that its adjunctive width varies along its adjunctive length. Inventive practice usually provides for an inventive adjunct that extends lengthwise in the approximate range between half of the hull bottom's length and the hull bottom's entire length, and that—along at least substantially all of its lengthwise extent—extends widthwise in the approximate range between half of the hull bottom's width and the hull bottom's entire width. However, inventive practice can provide for an inventive adjunct that extends beyond the hull bottom's length and/or the hull bottom's width. For instance, an inventive adjunct can have an adjunctive length that is up to approximately one-and-one-half times the hull bottom's length, and/or have an adjunctive width that is or varies up to approximately one-and-one-half times the hull bottom's width.

According to frequent inventive practice, an inventive adjunct extends along at least approximately half of the hull bottom's length, and the entire or nearly the entire inventive adjunct extends across at least approximately half of the hull bottom's width. Otherwise expressed, the inventive adjunct's adjunctive length is at least half of the hull bottom's length, and the inventive adjunct's adjunctive width is at least half of the hull bottom's width along at least substantially all of its adjunctive length. According to typical inventive practice, at least some of the inventive adjunct extends across approximately all of the hull bottom's width and along at least approximately half of the hull bottom's length. That is, along at least approximately half of the hull bottom's length, the inventive adjunct or a portion thereof has an adjunctive width that approximately equals the hull bottom's width. The inventive adjunct can have an adjunctive width matching the hull bottom's width throughout its adjunctive length, or can include one or more additional lengthwise adjunctive sections of varying adjunctive widths. To reemphasize, depending on the inventive embodiment, an inventive adjunct's adjunctive width can either be constant or variable along its adjunctive length, and, if variable, can be variable in any of diverse ways along its adjunctive length.

The present invention, as typically practiced, uniquely features attachment of inventive structure to an existing hull in order to resolve shortcomings with craft performance. The inventive add-on structure can be temporary or semi-permanent (e.g., attachable and detachable), or permanent, vis-à-vis the marine hull with which the inventive add-on structure is associated. The inventive add-on structure can be constituted by any suitable material or materials, including but not limited to metal or metal alloy (e.g., aluminum or steel), wood, plastic, or composite (e.g., fiberglass or other fiber-reinforced plastic). Known armor materials (e.g., metallic or composite) may be propitious for some inventive applications. As frequently embodied, the present invention's add-on structure is a comparatively inexpensive, sacrificial structure designed to easily attach to the underside of a small craft, in a manner somewhat analogous to the fitting of a shoe beneath a person's foot.

Some motivation for the present invention was provided by certain small marine craft that are currently implemented by U.S. Navy and U.S. Marine Corp personnel. Some small craft are less than entirely suitable for their current usage, as several conditions and threats are manifest that were not envisioned during their design and development. Problems encountered with some craft are currently addressed by reduced service hours and continual field repairs of the hulls, which experience excessive and repeated damage. An effective but costly solution is to replace a given craft with a new craft designed specifically for an application.

For instance, a craft may have been originally intended for both riverine (riparian) and ocean environments, for high speeds, and for low speed beaching in sand, mud, and loose gravel bottoms. These design requirements may conflict with operational requirements of the craft as currently employed in certain waters. Some craft may have experienced excessive bottom damage and wear, since the (e.g., aluminum) hull structure of the craft does not perform well in very shallow and rocky river areas. Furthermore, threats may persist of explosions from underwater mines and waterborne IEDs.

The present invention obviates replacement of an existing marine craft with an equally effective but much less costly solution—one that avoids much higher costs associated with acquiring new craft for the environment and threats of a particular locale. A main feature of typical inventive practice is the adjunctive alteration of the deadrise angle of the existing hull. As an example, an 18° deadrise angle may have been originally chosen for a craft's hull to provide a better ride quality for operating in ocean environments, but results in too deep a draft when operating in rocky bottomed or debris-laden rivers. The present invention's add-on structure can reduce the deadrise angle (e.g., a few or several degrees) of the craft's hull bottom, thereby reducing the draft of the craft. For instance, an inventively reduced deadrise angle of 13° may be more suitable than the original 18° deadrise angle for most riverine environments in a given region.

The shallower draft brought about by the inventive add-on structure not only serves to promote a more suitable draft and a more acceptable ride and maneuvering quality for craft operation in certain river environments, but concomitantly also serves to reduce erosive and damaging contact with the rough terrain of the river bottoms. Furthermore, the inventive add-on structure can represent the second skin/layer of the craft's hull bottom, wherein the original hull bottom represents the first skin/layer. The inventive add-on structure can thus function not only as a protective layer against wear and damage, but also as an add-on armor device. The inventively constructed double-skin (double-layer) hull bottom (which includes the original hull bottom and the inventive add-on structure) will be significantly more resistant to damage caused by blasts and/or projectiles than would a single-skin (single-layer) hull bottom.

Thus, as in the above example, inventive practice can resolve at least three basic issues, viz., deadrise incompatibility with mission, hull bottom damage/wear, and underwater explosion (UNDEX) susceptibility. The above-noted utilization of a small military craft is merely a case in point, as inventive modification of a variety of existing craft can meet a variety of new challenges in a variety of contexts. Generally speaking, inventive practice accomplishes the dual purpose of (a) changing the hydrodynamic and/or hydrostatic (e.g., buoyant) properties of a marine craft, and (b) affording additional protection to the underside of a marine craft; the additional protection can be in the nature of armor protection (e.g., protection against projectiles and blasts) and/or contact-damage-and-wear protection (e.g., more resilient or sacrificial protection against unfriendly underwater terrain). Inventive practice can improve maneuverability/handling characteristics and other characteristics of a hull with respect to a specific environment, and can protect against a variety of submerged hazards, natural or man-made, to navigation.

The present invention can be practiced in association with any marine vessel for which inventive deadrise modification would have concomitant benefits (including but not limited to draft modification, improved operability, wear/damage reduction, UNDEX resistance, etc.) in contemplated navigational environments. Inventive practice is possible not only in association with a monohull (single-hull) marine vessel but also in association with a multihull (plural-hull) marine vessel, such as a catamaran, a proa, or a trimaran. In other words, inventive principles can be brought to bear with respect to any hull, regardless of whether it is the hull of a single-hull craft or a plural-hull craft.

The present invention can be practiced in combination with non-inventive methods, techniques, or devices to further improve hydrostatic performance and/or hydrodynamic performance of a marine vessel. Examples of performance issues that may be addressed via corrective strategies including inventive practice and non-inventive measures include running trim, static trim, dynamic instability, acceleration from rest, and top speed.

Other objects, advantages, and features of the present invention will become apparent from the following detailed description of the present invention when considered in conjunction with the accompanying drawings.

BRIEF DESCRIPTION OF THE DRAWINGS

The present invention will now be described, by way of example, with reference to the accompanying drawings, wherein like numbers indicate same or similar parts or components, and wherein:

FIG. 6 depicts, in a coupled state, the inventive combination shown in FIG. 5.

FIG. 13 through FIG. 36 are aft elevation schematic and aft elevation views illustrating coupling of various inventive adjunctive structure embodiments with various marine hulls. FIG. 14 depicts, in a coupled state, the inventive combination shown in FIG. 13. FIG. 16 depicts, in a coupled state, the inventive combination shown in FIG. 15. FIG. 18 depicts, in a coupled state, the inventive combination shown in FIG. 17. FIG. 20 depicts, in a coupled state, the inventive combination shown in FIG. 19. FIG. 22 depicts, in a coupled state, the inventive combination shown in FIG. 21. FIG. 24 depicts, in a coupled state, the inventive combination shown in FIG. 23.

FIG. 26 depicts, in a coupled state, the inventive combination shown in FIG. 25. FIG. 28 depicts, in a coupled state, the inventive combination shown in FIG. 27. FIG. 30 depicts, in a coupled state, the inventive combination shown in FIG. 29. FIG. 32 depicts, in a coupled state, the inventive combination shown in FIG. 31. FIG. 34 depicts, in a coupled state, the inventive combination shown in FIG. 33. FIG. 36 depicts, in a coupled state, the inventive combination shown in FIG. 35.

DESCRIPTION OF EXEMPLARY EMBODIMENTS OF THE INVENTION

Figures 1, 2, 3:
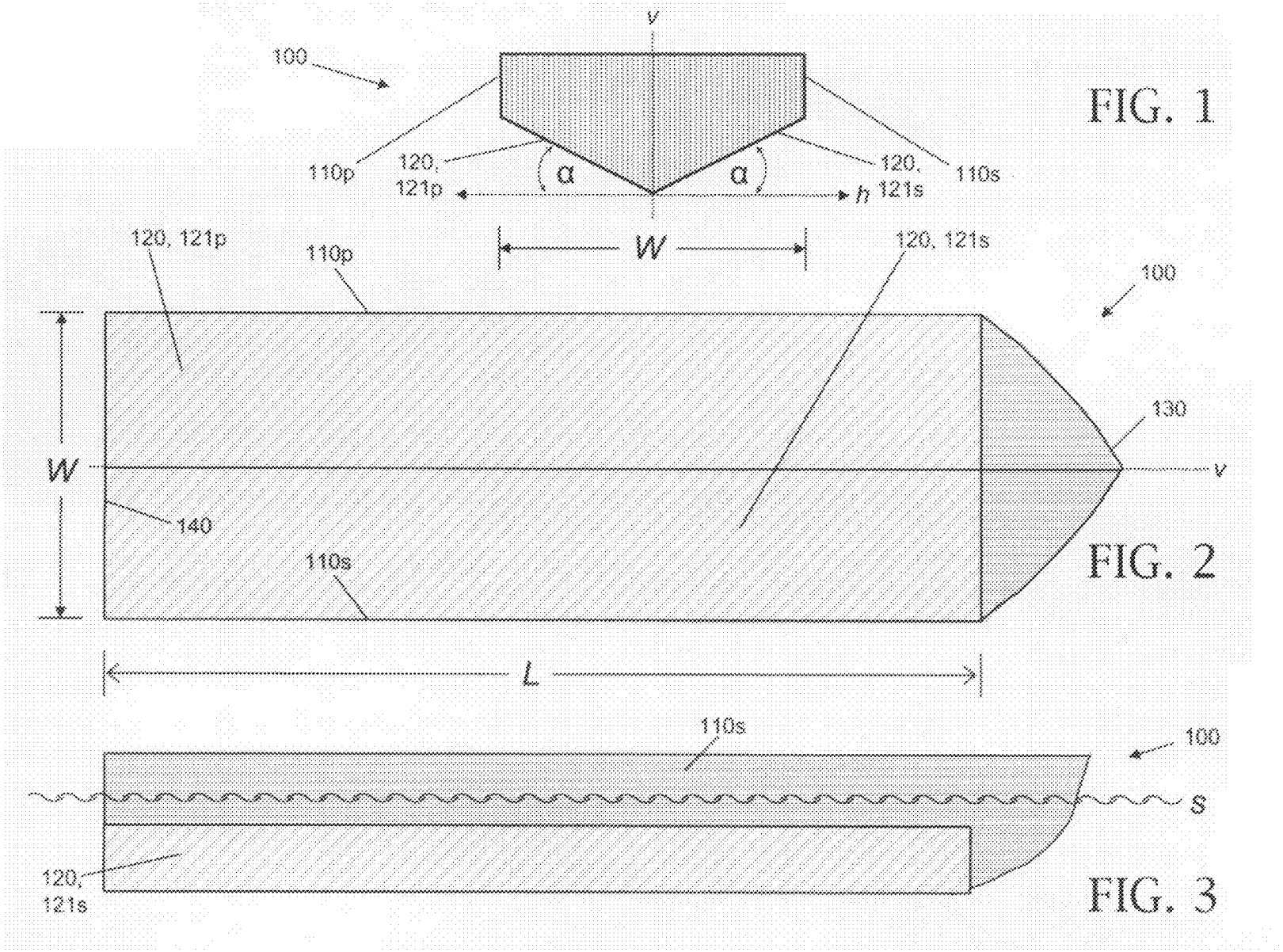
FIG. 1 is aft elevation view of an example of a marine hull suitable for inventive practice.
FIG. 2 is a top plan view of the marine hull shown in FIG. 1.
FIG. 3 is a starboard elevation view of the marine hull shown in FIG. 1 and FIG. 2.

Referring now to FIG. 1 through FIG. 3, marine vessel hull 100 includes a port (left) side 110*p*, a starboard (right) side 110*s*, a hull bottom 120, a bow 130, and a stem 140. Hull bottom 120 is characterized by a hull bottom length L and a hull bottom width W. Hull 100 is symmetrical with respect to a geometric vertical hull-bisector plane v, in which lies hull 100's centerline. Hull 100's waterline s shown in FIG. 3 corresponds to the surface of the water in which hull 100 is afloat.

Hull bottom 120 shown in FIG. 1 is a "V-shaped" hull bottom. A V-shape is illustrated, by way of example, by the equal and opposite upward sloping of hull bottom half-sections 121*s* and 121*p* in FIG. 1. Hull bottom 120's two half-sections on opposite sides of geometric vertical bisector plane v—viz., starboard hull bottom half-section 121*s* and port hull bottom half-section 121*p*—each describe the same angle $\alpha$ with respect to geometric horizontal plane h.

The term "V-shape" is conventionally used to refer to a hull bottom having a transverse profile characterized by an upright V-like shape. The term "inverted V-shape" has been used to refer to a hull bottom having a transverse profile characterized by an inverted (upside-down) V-like shape. As the terms "V-shaped," "inverted V-shaped," and "flat" are used herein to describe a surface (such as a hull bottom, the upper surface of an inventive adjunct, or the lower surface of an inventive adjunct): A V-shaped surface, such as shown by way of example in FIG. 1 and FIG. 13 through FIG. 24, is characterized by a positive deadrise angle. An inverted V-shaped surface, such as shown by way of example in FIG. 25 through FIG. 30, is characterized by a negative deadrise angle. A flat surface, such as shown by way of example in FIG. 31 through FIG. 36, is characterized by a zero deadrise angle.

Typical practice of the present invention involves inventively changing the deadrise angle of a V-angular hull bottom. The term "V-angular," as used herein to describe a surface (such as a hull bottom, the upper surface of an inventive adjunct, or the lower surface of an inventive adjunct), broadly refers to either an upright (positive-deadrise) V-shape, or an inverted (negative-deadrise) V-shape, or a flat (zero-deadrise) shape. In other words, a V-angular surface can be a V-shaped surface, or an inverted V-shaped surface, or a flat surface. Otherwise expressed, a V-angular surface is any surface that is characterized by a deadrise angle, either positive, or negative, or zero.

The present invention can be practiced, for example, to effectively convert: a positive-deadrise V-angular hull bottom to a different positive-deadrise V-angular hull bottom; a positive-deadrise V-angular hull bottom to a zero-deadrise V-angular hull bottom; a positive-deadrise V-angular hull bottom to a negative-deadrise V-angular hull bottom; a negative-deadrise V-angular hull bottom to a different negative-deadrise V-angular hull bottom; a negative-deadrise V-angular hull bottom to a zero-deadrise V-angular hull bottom; a negative-deadrise V-angular hull bottom to a positive-deadrise V-angular hull bottom; a zero-deadrise V-angular hull bottom to a positive-deadrise V-angular hull bottom; a zero-deadrise V-angular hull bottom to a negative-deadrise V-angular hull bottom.

The term "deadrise angle" (sometimes abbreviated herein as "deadrise") is used herein to refer to the angle that either half-section of a V-angular hull bottom describes with regard to the geometric horizontal plane passing through the vertex of the "V." Expressed another way, the deadrise angle is the angle between the bottom sides of the hull and the horizontal. For instance, as shown in FIG. 1, angle $\alpha$ is the deadrise angle (or simply, deadrise) of V-shaped hull bottom 120. The same deadrise angle $\alpha$ is formed by either hull bottom half-section 121*s* or hull bottom half-section 121*p* with respect to geometric horizontal plane h. Deadrise angle $\alpha$ shown in FIG. 1 is a positive angle. The terms "deadrise angle" and "deadrise" and "V-angularity" are used interchangeably herein.

Figure 6:
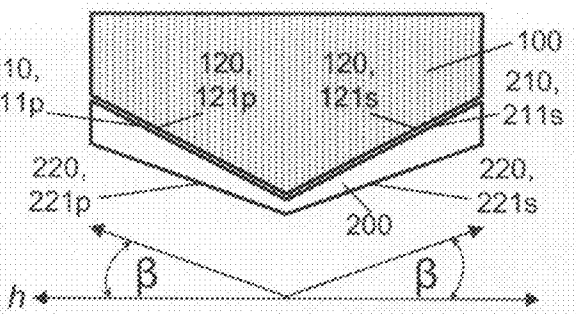
FIG. 5 and FIG. 6 are aft elevation schematic and aft elevation views, respectively, illustrating coupling of the inventive adjunctive structure shown in FIG. 4 with the marine hull shown in FIG. 1.
Figure 5:
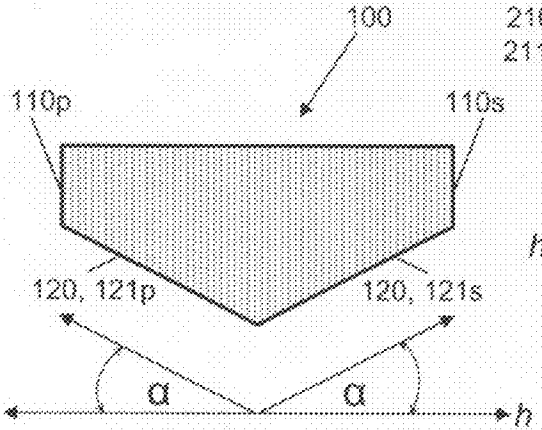
Figure 5:
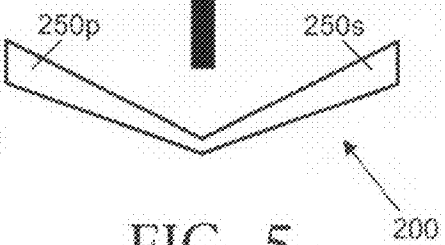
Figure 4:
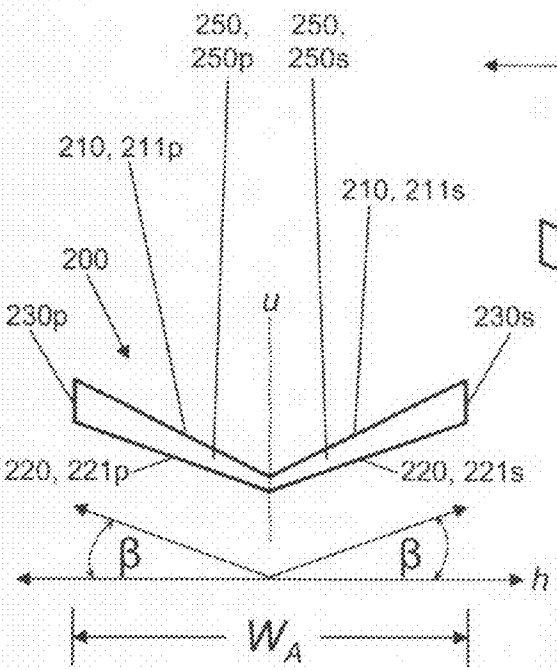
FIG. 4 is an aft elevation view of an embodiment of an adjunctive structure in accordance with the present invention.

With reference to FIG. 4 through FIG. 6, inventive adjunct 200 has an upper V-shaped adjunctive surface 210, a lower V-shaped adjunctive surface 220, a port adjunctive side surface 230*p*, and a starboard adjunctive side surface 230*s*. Upper adjunctive surface 210 includes a port upper adjunctive surface half-section 211*p* and a starboard upper adjunctive surface half-section 211*s*. Lower adjunctive surface 220 includes a port lower adjunctive surface half-section 221*p* and a starboard lower adjunctive surface half-section 221*s*. Inventive adjunct 200 is characterized by an adjunctive width $W_A$, which is the distance between adjunctive side surfaces 230*p* and 230*s*.

Inventive adjunct 200 includes two mirror-image wedge-shaped adjunctive half-sections 250, viz., port adjunctive half-section 250*p* and starboard adjunctive half-section 250*s*. An inventive adjunct 200 can be embodied either as an integral structure or as separate structures. For instance, an inventive adjunct 200 can be attached as a single structure to a marine hull bottom 120, the single structure including both adjunctive half-sections 250. Alternatively, an inventive adjunct 200 structure can be attached as two separate sub-structures (e.g., in two "pieces"), each sub-structure representing one of the two half-sections 250; that is, the port adjunctive half-section 250*p* sub-structure and the starboard adjunctive half-section 250*s* sub-structure are separately attached to the hull bottom 120.

As shown in FIG. 4, the two wedge-shaped half-sections 250 of inventive adjunct 200 are situated on opposite sides of a geometric vertical adjunct-bisector plane u, and are "mirror images" of each other with respect to "mirror plane" u. Geometrically speaking, either wedge-shaped section 250 can be flipped out-of-plane to be brought into coincidence with the other wedge-shaped section 250. The pair of wedge-shaped sections 250 are synonymously referred to herein as "oppositely congruent," or "mirror-imaged," or "mirror images," or "enantiomorphs." "Enantiomorph" is originally a Greek term meaning "in opposite form."

As illustrated in FIG. 4 through FIG. 6, inventive adjunct 200 is attached to hull 100 at the underside of hull 100, i.e., at hull bottom 120. Inventive adjunct 200 "fits" hull 100, somewhat similarly as a shoe fits a foot. Inventive adjunct 200's upper surface 210 is characterized by a V-angularity that matches the V-angularity of hull bottom 120; that is, adjunctive upper surface 210 and hull bottom 120 each have the same V-angularity α. In contrast, inventive adjunct 200's lower surface 220 is characterized by a V-angularity that differs from the V-angularity of hull bottom 120. Adjunctive lower surface 220 has V-angularity β, which is shown in FIG. 4 through FIG. 6 to be less than V-angularity a of hull bottom 120 and of adjunctive upper surface 210.

The respective half-section surfaces of the hull bottom 120 and the upper adjunctive surface 210 are adjacent to each other. Port upper adjunctive surface half-section 211*p* abuts port hull bottom half-section 121*p*; starboard upper adjunctive surface half-section 211*s* abuts starboard hull bottom half-section 121*s*. In effect, the uniting of hull 100 and inventive adjunct 200 results in a new, adjunctively enhanced marine hull, characterized by the adjunctive lower surface 220's V-angularity β instead of the hull bottom 120's V-angularity α.

In the example shown in FIG. 4 through FIG. 6, the deadrise angle of the marine hull is reduced from α to β, wherein α>β>0. FIG. 4 through FIG. 6 is roughly illustrative of inventive practice in association with the aforementioned U.S. Navy's SURC marine craft. The original SURC's hull bottom 120 is characterized by a deadrise angle α. of about eighteen degrees. Application of an inventive adjunct 200 having an adjunctive lower surface 220 characterized by a deadrise angle β of about thirteen degrees, resulting in a deadrise reduction of about five degrees, could significantly improve the SURC's performance under certain mission conditions.

The attachment of hull adjunct 200 to hull bottom 120 is conformal in the respect that upper adjunctive surface 210 and hull bottom 120 share the same V-angularity α, and in the respect that inventive adjunct 200 has approximately the same width $W_A$ as width W of hull bottom 120. According to typical inventive practice, the adjunctive width $W_A$ is approximately equal to the hull bottom width W; otherwise expressed, the respective widths of the two adjoining surfaces—viz., upper adjunctive surface 210 and hull bottom 120—are approximately equal, since the width of upper adjunctive surface 210 and adjunctive width $W_A$ are approximately equal.

Figure 7:
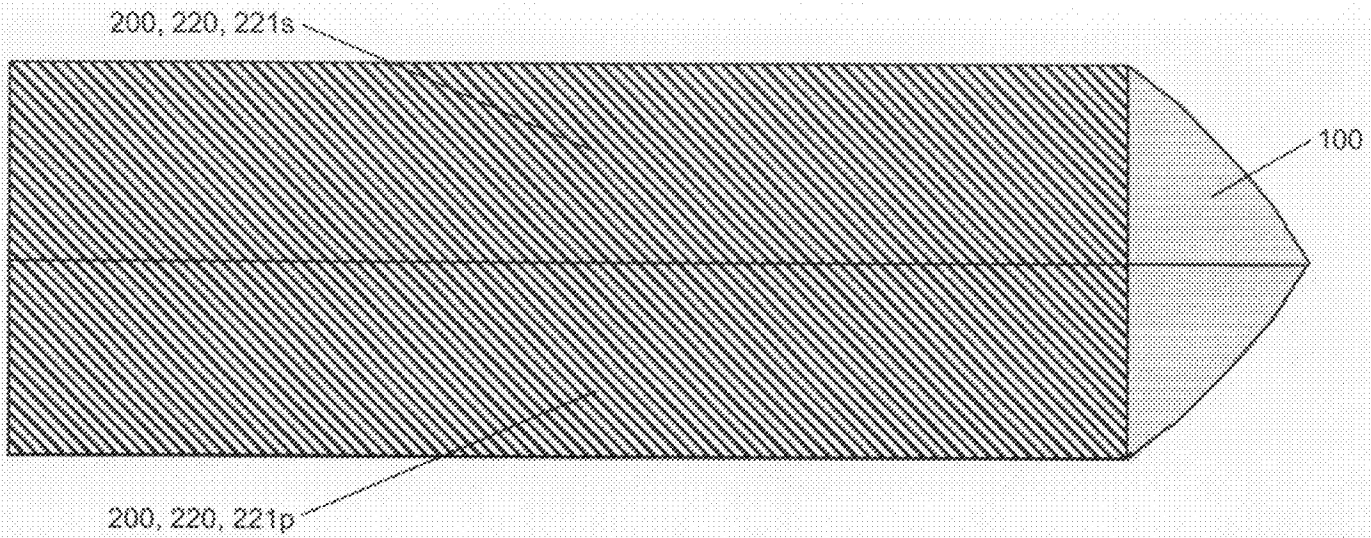
FIG. 7 and FIG. 8 are top plan and starboard elevation views, respectively, of the combination shown in FIG. 6, wherein the inventive adjunctive structure is embodied to extend approximately the entire length of the marine hull's bottom.
Figure 8:
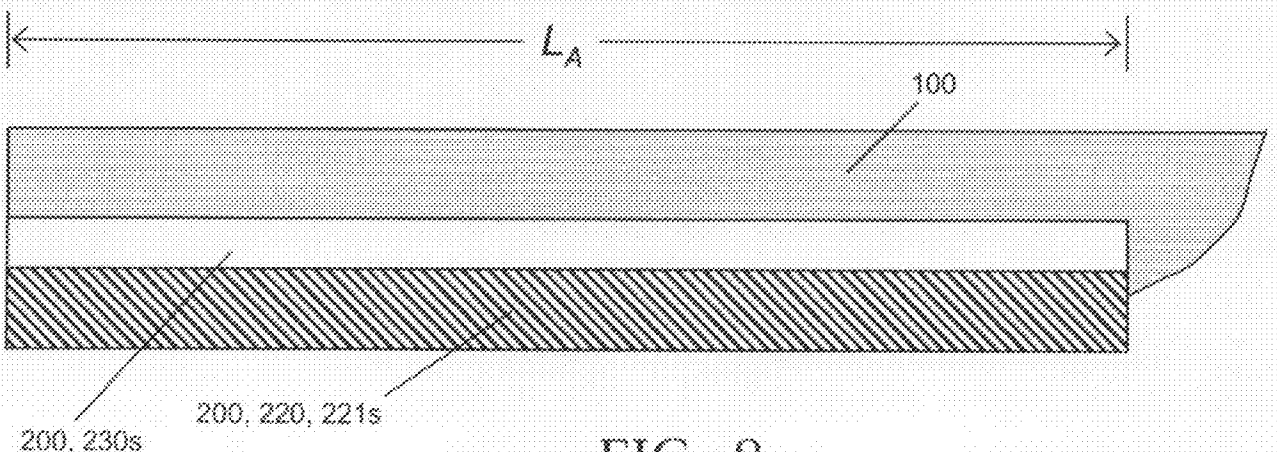
Figure 9:
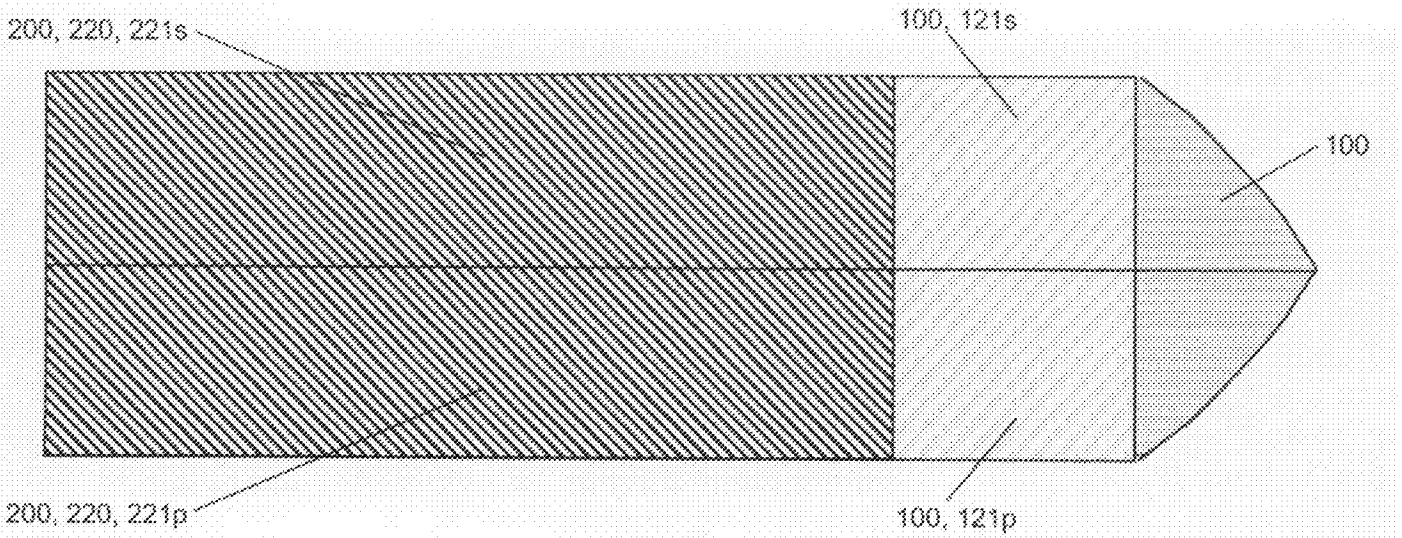
FIG. 9 and FIG. 10 are top plan and starboard elevation views, respectively, of the combination shown in FIG. 6, wherein the inventive adjunctive structure is embodied to extend most (approximately 80%) of the length of the marine hull's bottom.
Figure 10:
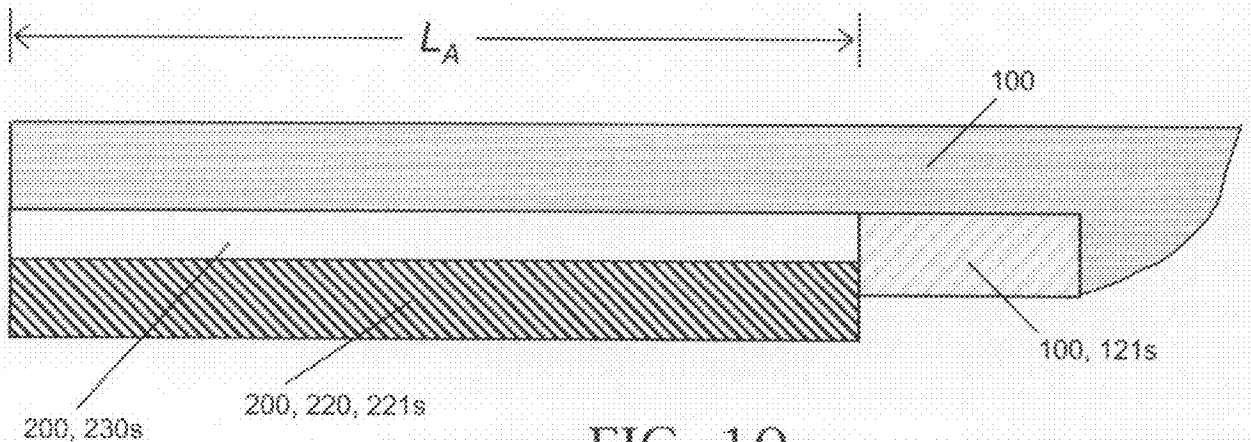
Figure 11:
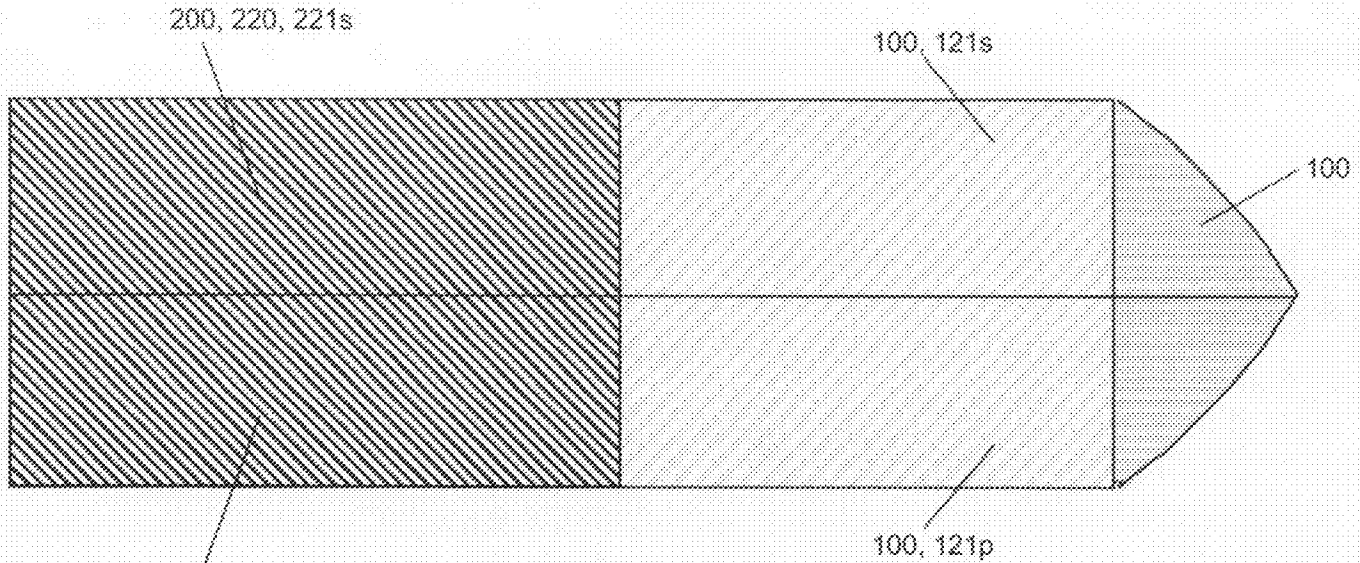
FIG. 11 and FIG. 12 are top plan and starboard elevation views, respectively, of the combination shown in FIG. 6, wherein the inventive adjunctive structure is embodied to extend approximately 50% of the length of the marine hull's bottom.
Figure 12:
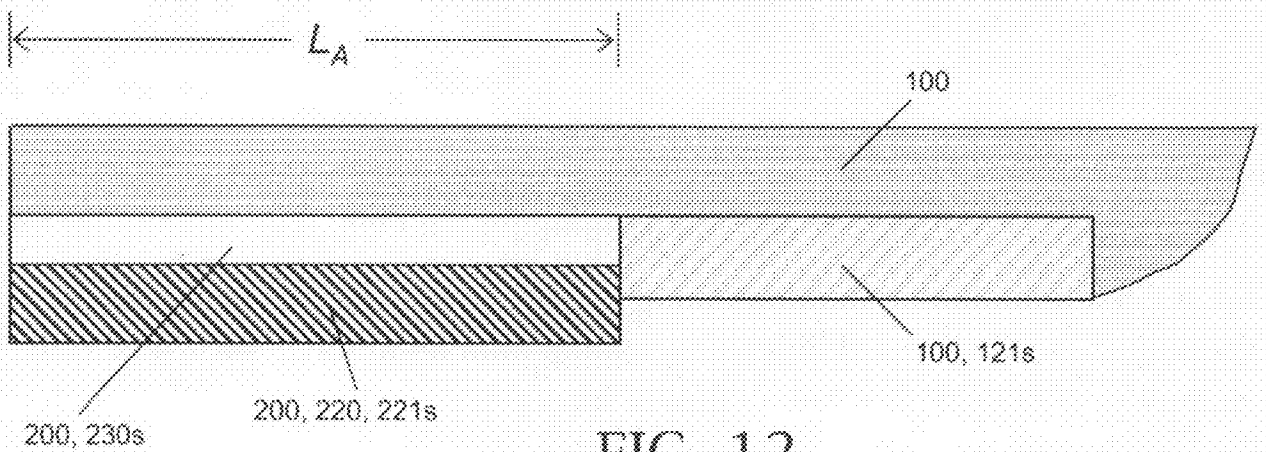

Reference now being made to FIG. 7 through FIG. 12, length $L_A$ of inventive adjunct 200 can be approximately the same as or can differ significantly from length L of hull bottom 120, depending on the inventive embodiment. As shown in FIG. 7 and FIG. 8, adjunctive length $L_A$ approximately equals hull bottom length L. As shown in FIG. 9 and FIG. 10, adjunctive length $L_A$ is approximately 77% of hull bottom length L. As shown in FIG. 11 and FIG. 12, adjunctive length $L_A$ is approximately 55% of hull bottom length L. In each of the three respective examples shown in FIG. 7 through FIG. 12, the inventive adjunct 200 commences at stern 140, i.e., is approximately even with the aft end of hull bottom 120. This manner of stern-and-forward attachment of an inventive adjunct 200 may serve hydrodynamic and/or hydrostatic (e.g., buoyant) objectives in many inventive applications. According to frequent inventive practice, adjunctive length $L_A$ is in the range between approximately 50% and approximately 100% of hull bottom length L.

With reference to FIG. 13 through FIG. 36, inventive practice is configurationally versatile, especially in terms of the respective V-angularities of the hull bottom 120 and the lower adjunctive surface 220. The inventive embodiments illustrated herein are by way of example. As will be apparent to the ordinarily skilled artisan who reads the instant disclosure, multifarious inventive embodiments other than those illustrated herein are possible in accordance with inventive practice.

As variously illustrated in FIG. 4 through FIG. 6, in FIG. 13 and FIG. 14, in FIGS. 17 and 18, and in FIG. 19 and FIG. 20, an inventive adjunct 200 is attached to a hull bottom 120 so as to yield an adjunctive positive deadrise β that is less than the original positive deadrise α. FIG. 13 and FIG. 14 show the same positive V-angularities α and β as do FIG. 4 through FIG. 6, except that inventive adjunct 200 shown in FIG. 13 and FIG. 14 includes two side projections 260—viz., a port adjunctive side projection 260*p* (above port adjunctive side surface 230*p*) and a starboard adjunctive side projection 260*s* (above starboard adjunctive side surface 230*s*)—which can serve to facilitate attachment of inventive adjunct 200 to hull bottom 120. FIG. 17 and FIG. 18 show inventive adjoining of correspondingly multi-chined surfaces—more specifically, a hull 100 having a multi-chined hull bottom 120, and attachment thereto of an inventive adjunct 200 having a correspondingly multi-chined upper adjunctive surface 210. FIG. 19 and FIG. 20 show the same positive deadrise α as do FIG. 4 through FIG. 6, but show a smaller positive deadrise β than do FIG. 4 through FIG. 6.

FIG. 15 and FIG. 16 depict the attachment of an inventive adjunct 200 to a hull bottom 120 so as to obtain an adjunctive positive deadrise β that is greater than the original positive deadrise α. This is in contradistinction to the more usual inventive practice of obtaining an adjunctive positive deadrise β that is less than the original positive deadrise α, as exemplified in FIG. 4 through FIG. 6, in FIG. 13 and FIG. 14, in FIGS. 17 and 18, and in FIG. 19 and FIG. 20. Inventive adjunct 200 shown in FIG. 15 and FIG. 16 also includes two mirror-image wedge-shaped adjunctive half-sections 250*p* and 250*s*, situated on opposite sides of mirror plane u. However, as distinguished from an inventive adjunct 200 such as shown in FIG. 4 through FIG. 6, an inventive adjunct 200 such as shown in FIG. 15 and FIG. 16 has the thicker respective ends of the wedge-shaped adjunctive half-sections 250 meeting at mirror plane u. In contrast, as depicted in FIG. 4 through FIG. 6, in FIG. 13 and FIG. 14, in FIGS. 17 and 18, and in FIG. 19 and FIG. 20, the thinner respective ends of the wedge-shaped adjunctive half-sections 250 meet at mirror plane u.

FIG. 21 and FIG. 22 show the same positive deadrise α as do FIG. 4 through FIG. 6 and FIGS. 19 and 20, and similarly show a deadrise β that is less than deadrise α. However, FIG. 21 and FIG. 22 show an even smaller deadrise β than do FIG. 19 and FIG. 20. FIG. 21 and FIG. 22 show a deadrise β that is neither a positive deadrise β nor a negative deadrise β, but is in fact a zero deadrise β. Thus portrayed by FIG. 21 and FIG. 22 is the attachment of an inventive adjunct 200 to a hull bottom 120 having a positive deadrise α so as to obtain an adjunctive zero-degree (linear) deadrise β, thereby imparting a "flat bottom" to the hull.

FIG. 23 and FIG. 24 show the same positive deadrise α as do FIG. 4 through FIG. 6 and FIG. 19 through FIG. 22, and similarly show a deadrise β that is less than deadrise α. However, FIG. 23 and FIG. 24 show a deadrise β that is neither a positive deadrise β nor a zero deadrise β, but is in fact a negative deadrise β. Thus portrayed by FIG. 23 and FIG. 24 is the attachment of an inventive adjunct 200 to a hull bottom

120 having a positive deadrise α so as to obtain an adjunctive negative deadrise β, thereby imparting an "inverted-V-shape" to the hull.

Figures 25, 26, 27, 28, 29, 30:
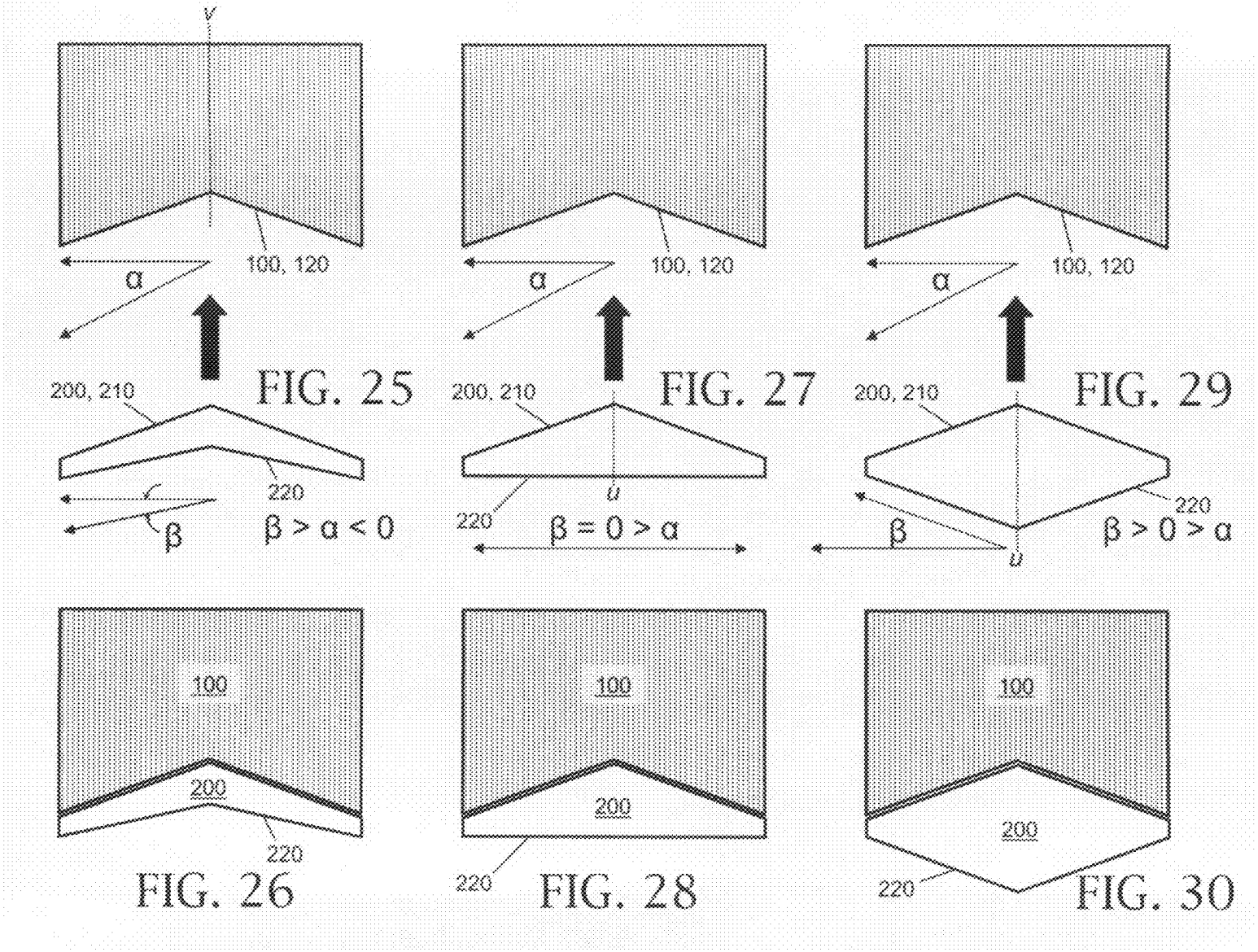

FIG. 4 through FIG. 6 and FIG. 13 through FIG. 24 are similar insofar as illustrating inventive adjustment, to an adjunctive deadrise β, from an original deadrise α that is positive. By comparison, FIG. 25 through FIG. 30 illustrate inventive adjustment, to an adjunctive deadrise β, from an original deadrise α that is negative; FIG. 31 through FIG. 36 illustrate inventive adjustment, to an adjunctive deadrise β, from an original deadrise a that is zero. As shown in FIG. 25 and FIG. 26, a negative deadrise α is inventively adjusted to a negative deadrise β that is greater than negative deadrise α; looked at another way, as shown in FIG. 25 and FIG. 26, the absolute value of the adjustment negative deadrise β is less than the absolute value of the initial negative deadrise α. As shown in FIG. 27 and FIG. 28, a negative deadrise α is inventively adjusted to a zero deadrise β. As shown in FIG. 29 and FIG. 30, a negative deadrise α is inventively adjusted to a positive deadrise β. As shown in FIG. 31 and FIG. 32, a zero deadrise α is inventively adjusted to a positive deadrise β. As shown in FIG. 33 and FIG. 34, a zero deadrise α is inventively adjusted to a negative deadrise β. As shown in FIG. 35 and FIG. 36, a zero deadrise α is inventively adjusted to a positive, multi-chined deadrise β, thereby imparting a "multi-chined V-shape" to the originally flat-bottomed hull.

In terms of engineering and economic feasibility, the inventive practitioner will frequently work in one-degree increments of deadrise alteration. For instance, if a deadrise alteration of around one or two degrees may be under consideration, the inventive practitioner may choose to render either a one-degree alteration or a two-degree alteration. He or she may view rendering a one-half-degree alteration as being too small an adjustment (e.g., the cost exceeds the benefit), or may view rendering a one-and-one-half degree alteration as being an unnecessarily fine adjustment, versus either a one-degree alteration or a two-degree alteration. According to typical inventive practice, cost-benefit factors will be brought to bear to a proposed application of the present invention. For instance, a proposed deadrise alteration in accordance with the present invention that is too small to make a highly significant hydrodynamic/hydrostatic difference, albeit serving other (e.g., protective) purposes, may be dismissed as not worth the expense. As a general rule, inventive practice will usually provide for a deadrise alteration of at least one degree, more usually at least two degrees.

Figures 37, 38:
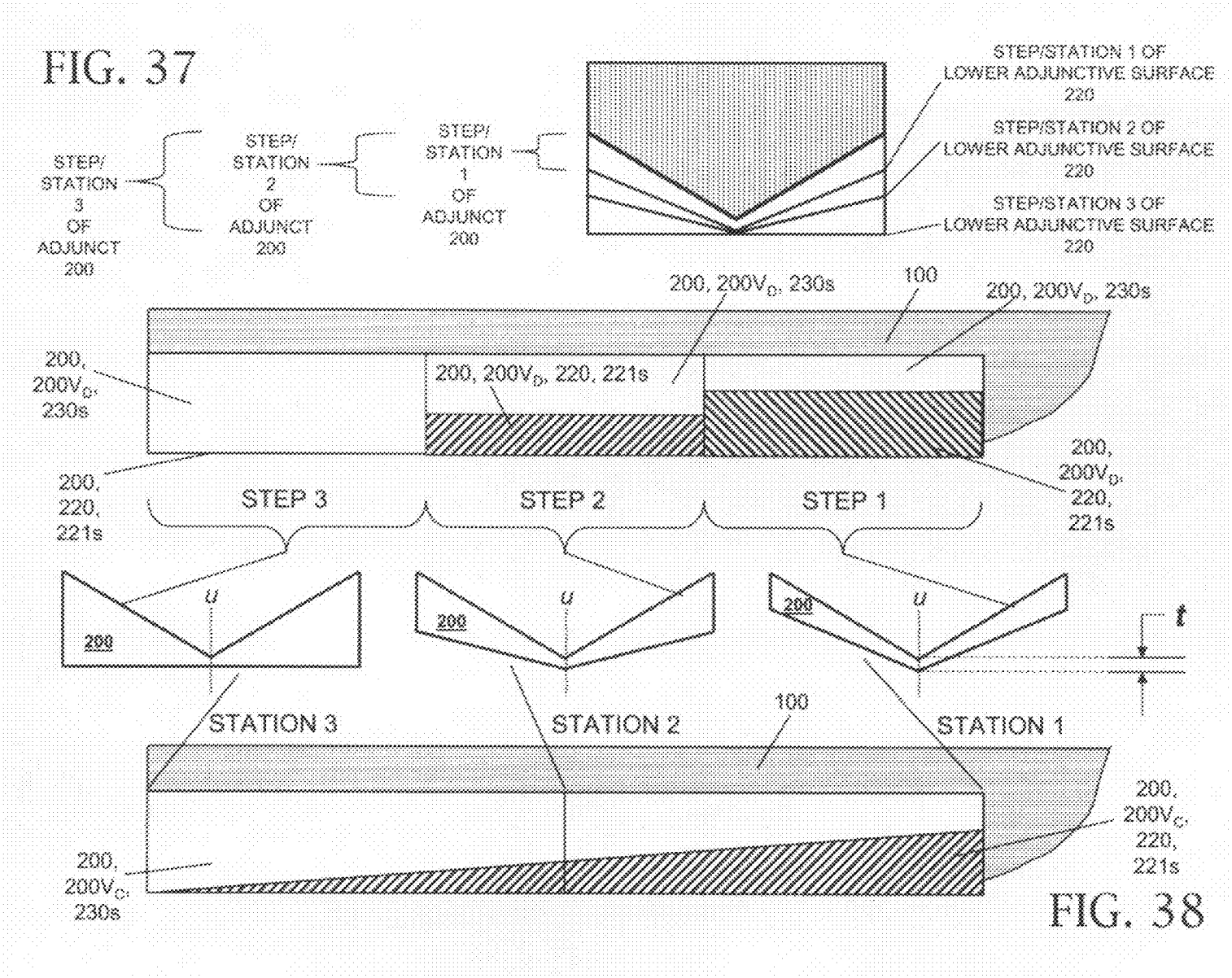
FIG. 37 and FIG. 38 are aft elevation schematic and starboard elevation schematic views, respectively, illustrating examples of inventive practice in which the inventive adjunctive structure is characterized by discretely variable angularity or continuously variable angularity.

With reference to FIG. 37 and FIG. 38, it may be desirable to inventively change a longitudinally constant (uniform) deadrise angle α of a marine hull bottom 120 to a longitudinally variable deadrise angle β. Such inventive practice may effect either a continuously variable deadrise angle β (such as exemplified by inventive adjunct 200$V_C$) or a discretely variable deadrise angle β (such as exemplified by inventive adjunct 200$V_D$). In either case, a marine hull 100 having a deadrise angle α that is constant along its length (e.g., plane v) is inventively altered to have a deadrise angle β that varies along its length (e.g., plane v). Inventive adjunct 200$V_C$ has a V-shaped lower adjunctive surface 220 characterized by a deadrise β that gradually decreases aftward along its length from a first deadrise β ("Station 1"—approximately 22°) to a second deadrise β ("Station 2"—approximately 14°) to a third deadrise β ("Station 3"—0°). Similarly, inventive adjunct 200$V_D$ has a V-shaped lower adjunctive surface 220 characterized by a deadrise β that decreases aftward in steps along its length from a first deadrise β ("Step 1"—approximately 22°) to a second deadrise β ("Step 2"—approximately 14°) to a third deadrise β ("Step 3"—0°).

FIG. 37 and FIG. 38 show mere examples of inventive practice. For instance, although FIG. 37 and FIG. 38 portray an inventive adjunct 200$V_D$ having three "steps," practically any number of plural steps is possible for an inventive discretely variable deadrise adjunct. As another example, an inventive discretely variable deadrise adjunct can effect an aftward increasing deadrise, rather than an aftward decreasing deadrise such as shown in FIG. 37 and FIG. 38. As a further example, an inventive discretely variable deadrise adjunct can be attached as an integral structure or as separate sub-structures, each representing a particular adjunctive deadrise angle β. In the light of this disclosure, those skilled in the art will appreciate the diverse ways, in accordance with the present invention, in which a constant deadrise hull can be altered to a different constant deadrise hull, a variable deadrise hull can be altered to a different variable deadrise hull, a constant deadrise hull can be altered to a variable deadrise hull, and a variable deadrise hull can be altered to a constant deadrise hull.

As a general qualification herein, the drawings are highly diagrammatic in nature and are not intended to suggest desirability of particular inventive embodiments or configurations. For instance, in figures herein that show inventive adjuncts attached to hull bottoms, distances and/or shapes and/or proportions may be exaggerated or simplified for illustrative purposes. According to typical inventive practice, an appropriate degree of sophistication and exactitude will be exercised in designing an inventive adjunct 200 in contemplation of use in association with a particular marine hull 100.

Several inventive parameters can be selected and varied by an inventive practitioner in order to arrive at a design of an inventive adjunct 200 that is suitable for a particular marine hull 100, including the following: (i) vertical middle thickness t of inventive adjunct 200; (ii) width (beam) of inventive adjunct 200; (iii) deadrise (V-angularity) of inventive adjunct 200; (iv) Δ deadrise; (v) material composition of inventive adjunct 200. The "vertical middle thickness," also referred to herein as the "adjunctive keel thickness," is the vertical distance in the geometric bisector plane u between the upper adjunctive surface 210 and the lower adjunctive surface 220. "Δ deadrise" is the change or difference between the hull bottom 100's deadrise angle and the inventive adjunct 200's deadrise angle; Δ deadrise is mathematically related to the deadrise values of the hull 100 and of the inventive adjunct 200.

Figure 39:
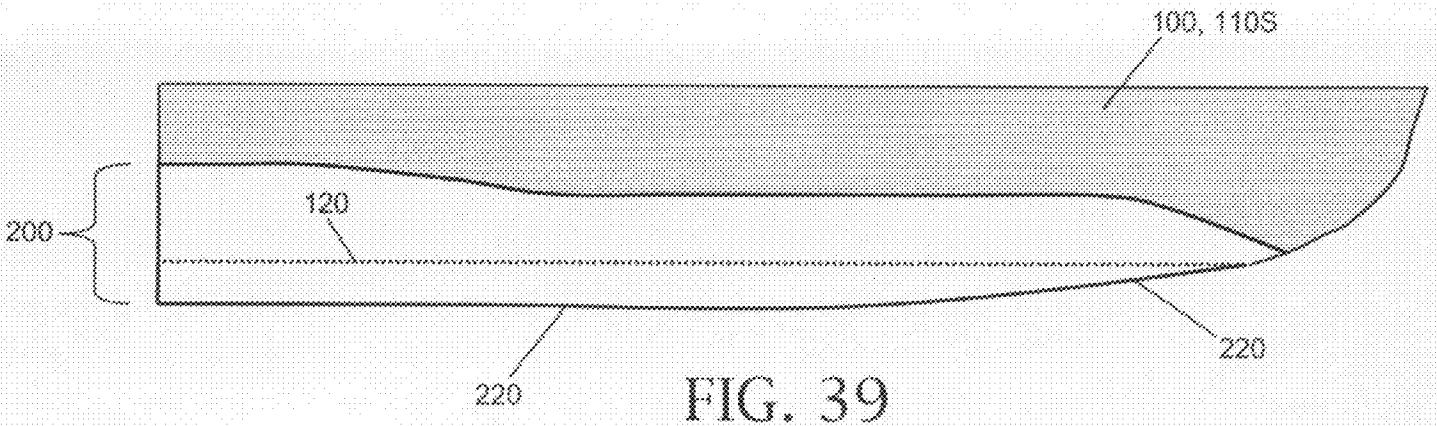
FIG. 39 and FIG. 40 are starboard elevation and bottom plan views, respectively, illustrating examples of inventive practice in which the inventive adjunctive structure is characterized by variable angularity and/or variable thickness and/or variable width.
Figure 40:
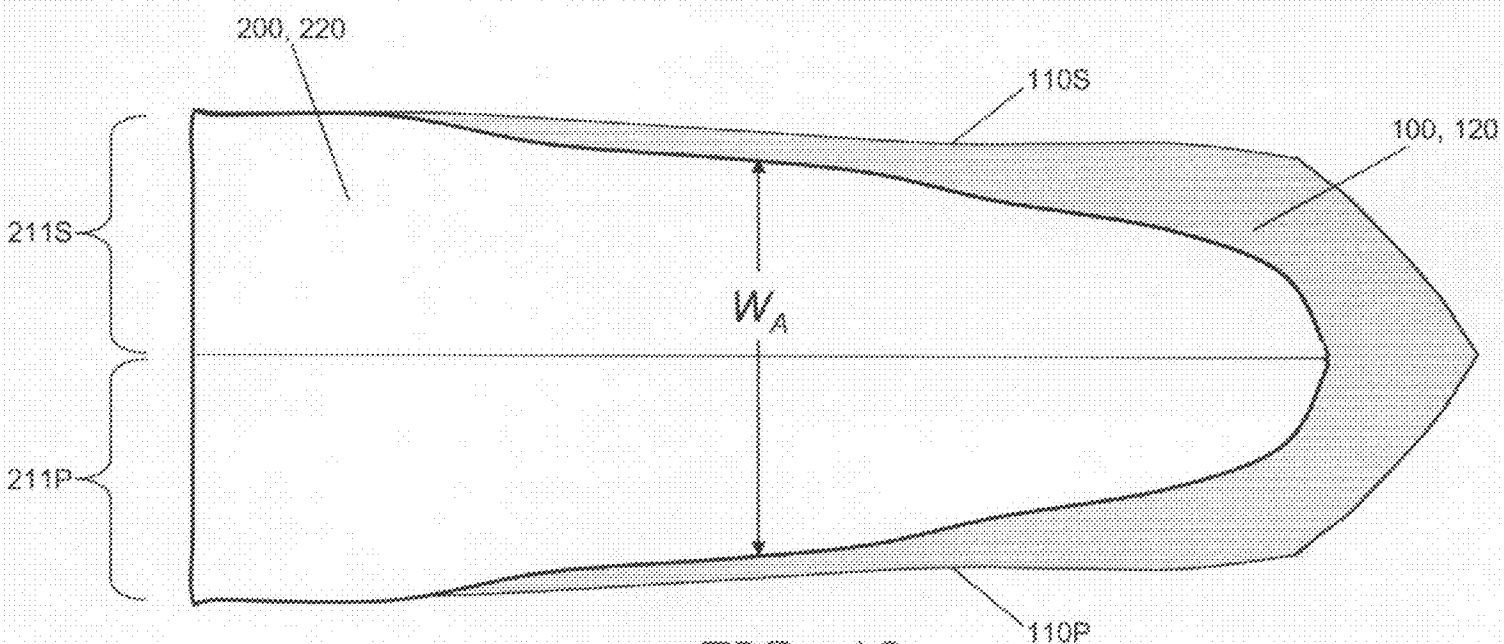

Any one or any combination of these parameters can be varied to achieve desired tailoring or contouring of the hull bottom. For instance, with reference to FIG. 39 and FIG. 40, an inventive adjunct embodiment can be configured so as to be characterized at the front by a relatively thin vertical middle thickness t and/or a relatively small Δ deadrise, thereby representing a kind of fairing for front-to-back transition of the hull 100's underside from its original hull bottom 120 to the inventive adjunct 200's lower adjunctive surface 220. As also shown by way of example in FIG. 39 and FIG. 40, the adjunctive (beam) width $W_A$ can be configured to be relatively narrow in the front, and to widen toward the back of the inventive adjunct 200. Adjunctive width $W_A$ can even be configured to exceed the hull bottom width W along at least a portion of hull bottom 120, such as exhibited in FIG. 39 and FIG. 40 by inventive adjunct 200 in its aft region.

Figure 41:
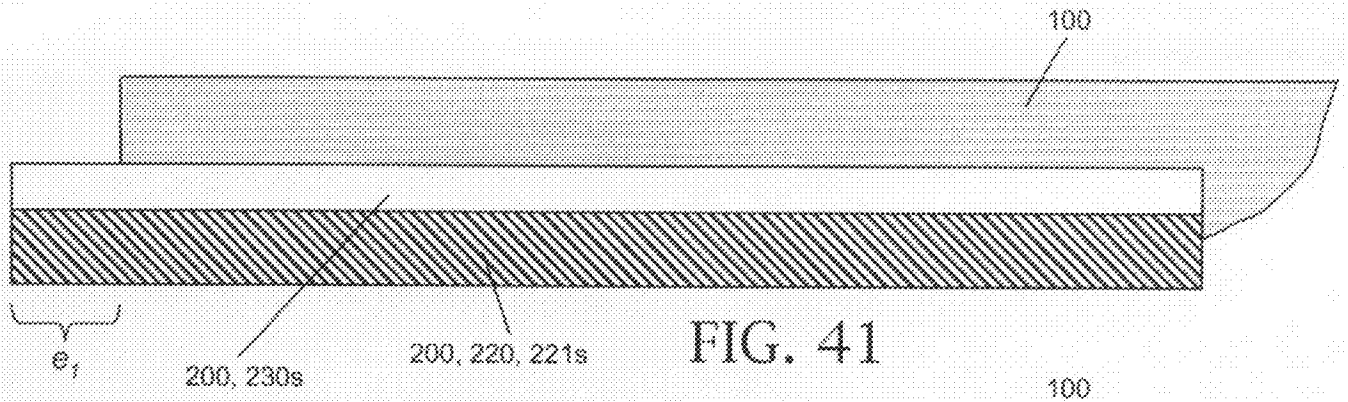
FIG. 41 through FIG. 43 are starboard elevation views of various examples of an "aft projection" mode of inventive practice. An inventive adjunctive structure is shown in each figure in combination with a marine hull such as depicted in FIG. 2, wherein the inventive adjunctive structure extends rearward beyond (behind) the stern of the marine hull.
Figure 42:
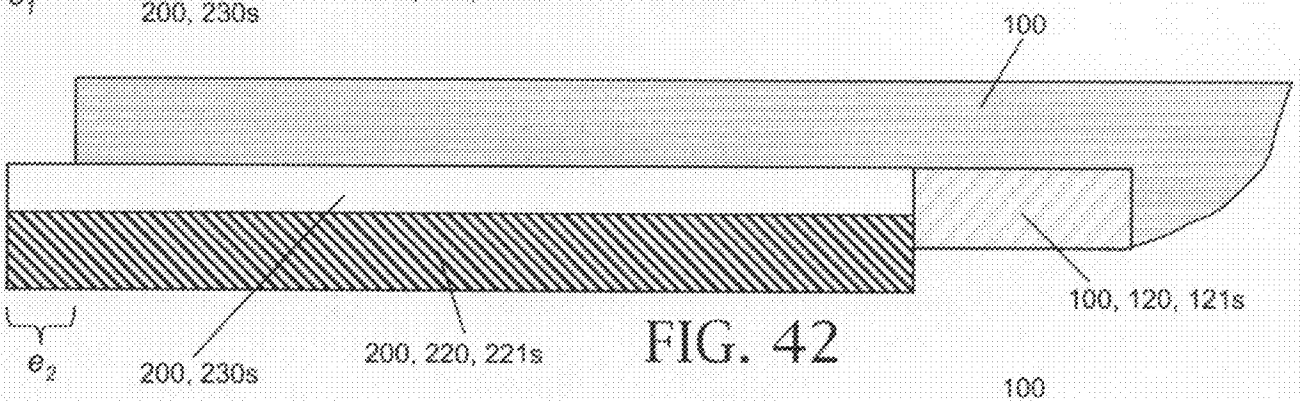
Figure 43:
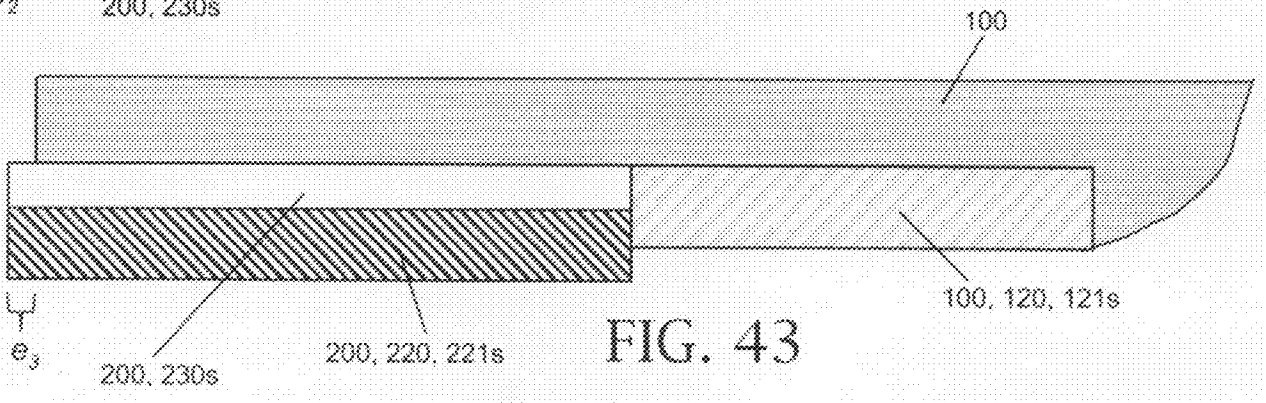

As shown by way of example in FIG. 7 through FIG. 12, most embodiments of the present invention provide for attachment of an inventive adjunct to a marine hull so that the inventive adjunct is coextensive, or approximately so, with the stern of the marine hull. Now referring to FIG. 41 through FIG. 43, some embodiments of the present invention provide for attachment of an inventive adjunct to a marine hull so that the inventive adjunct extends aftward beyond the stern of marine hull, in other words overlaps (or, to be more accurate literally, "underlaps") the marine hull. As examples, FIG. 41 shows an inventive adjunct 200 that is coextensive with hull bottom 120 in the front, and that extends behind hull bottom 120 in the back by distance $e_1$. FIG. 42 shows an inventive adjunct 200 that extends to a location distanced from the front of hull bottom 120, and that extends behind hull bottom 120 in the back by distance $e_2$, which is smaller than distance $e_1$. FIG. 43 shows an inventive adjunct 200 that extends to a location distanced (more distanced than shown in FIG. 40) from the front of hull bottom 120, and that extends behind hull bottom 120 in the back by distance $e_3$, which is smaller than distance $e_2$. The aftward projection of an inventive adjunct may serve a hydrodynamic/hydrostatic purpose such as encouraging planing of the marine hull.

The present invention, which is disclosed herein, is not to be limited by the embodiments described or illustrated herein, which are given by way of example and not of limitation. Other embodiments of the present invention will be apparent to those skilled in the art from a consideration of the instant disclosure or from practice of the present invention. Various omissions, modifications, and changes to the principles disclosed herein may be made by one skilled in the art without departing from the true scope and spirit of the present invention, which is indicated by the following claims.

What is claimed is:

1. An apparatus comprising a double-wedge-shaped adjunct for a marine hull, said hull having a rigid V-angular hull bottom that is characterized by a first deadrise angle, a hull bottom length, and a hull bottom width, said adjunct having a V-angular upper adjunct surface and a V-angular lower adjunct surface, said upper adjunct surface being characterized by the first said deadrise angle, said lower adjunct surface being characterized by a second said deadrise angle, said adjunct being made entirely of a rigid and noncompressible material and being characterized by a shape capable of resisting deformation, said upper adjunct surface being conformal with said hull bottom to maintain continuous flush attachment of said adjunct underneath at least a portion of said hull bottom whereby said adjunct is coextensive with at least approximately half said hull bottom length and at least in part is coextensive with approximately the entire said hull width for at least approximately half said hull bottom length, said hull bottom being changed by said flush attachment so as to be characterized by the second said deadrise angle, the second said deadrise angle differing from the first said deadrise angle and thereby imparting a substantially different hydrodynamic character.

2. The apparatus of claim 1, wherein said adjunct is detachable from said hull.

3. The apparatus of claim 1, wherein said flush mounting is permitted whereby said adjunct is coextensive with approximately the entire said hull length.

4. The apparatus of claim 1, wherein the second said deadrise angle differs at least two degrees from the first said deadrise angle.

5. The apparatus of claim 1, wherein the second said deadrise angle is at least two degrees greater than the first said deadrise angle.

6. The apparatus of claim 1, wherein the second said deadrise angle is at least two degrees less than the first said deadrise angle.

7. The apparatus of claim 1 further comprising said hull, the apparatus thereby comprising the combination of said hull and said adjunct wherein said adjunct is attachable to said hull.

8. The apparatus of claim 7, wherein said adjunct is detachable from said hull.

9. The apparatus of claim 7, wherein said flush mounting is permitted whereby said adjunct is coextensive with approximately the entire said hull length.

10. The apparatus of claim 7, wherein the second said deadrise angle differs at least two degrees from the first said deadrise angle.

11. The apparatus of claim 7, wherein the second said deadrise angle is at least two degrees greater than the first said deadrise angle.

12. The apparatus of claim 7, wherein the second said deadrise angle is at least two degrees less than the first said deadrise angle.

13. The apparatus of claim 1, wherein said adjunct extends behind said hull bottom a distance in the range between approximately three percent and approximately ten percent of said hull bottom length.

14. A deadrise-altering device for association with a marine hull that is characterized by a geometric longitudinal centerline and that has a rigid V-angular hull bottom surface, said hull bottom surface being characterized by a hull bottom length, a hull bottom width, and a hull bottom deadrise angle, the device comprising an adjunctive structure made entirely of a rigid and noncompressible material and characterized by a shape capable of resisting deformation, said adjunctive structure including a pair of wedge-shaped sections that are mirror-imaged with respect to a geometric plane of symmetry, said adjunctive structure having a V-angular upper adjunctive surface and a V-angular lower adjunctive surface, said upper adjunctive surface being characterized by an upper adjunctive deadrise angle that equals said hull bottom deadrise angle, said lower adjunctive surface being characterized by a lower adjunctive deadrise angle that differs from said hull bottom deadrise angle and that thereby imparts a substantially different hydrodynamic character, said adjunctive structure maintaining continuous flush attachment beneath said hull bottom surface so that said geometric plane is vertical, said geometric centerline lies in the vertical said geometric plane, and at least a portion of said upper adjunctive surface adjoins said hull bottom surface across approximately all of said hull bottom width and along at least half of said hull bottom length, the flushly attached said adjunctive structure effectively altering said hull bottom deadrise angle so as to become said lower adjunctive deadrise angle.

15. The deadrise-altering device of claim 14, wherein said upper adjunctive surface is characterized by an upper adjunctive width, and wherein said upper adjunctive width at least approximately equals said hull bottom width.

16. The deadrise-altering device of claim 15, wherein said upper adjunctive surface is characterized by an upper adjunctive length, and wherein said upper adjunctive length at least approximately equals said hull bottom length.

17. The deadrise-altering device of claim 14, wherein each said section of said adjunctive structure is tapered in a direction toward said geometric longitudinal plane, and wherein said lower adjunctive surface is characterized by a lower adjunctive deadrise angle that is at least two degrees smaller than said hull bottom deadrise angle.

18. The deadrise-altering device of claim 14, wherein each said section of said adjunctive structure is tapered in a direction away from said geometric longitudinal plane, and wherein said lower adjunctive surface is characterized by a lower adjunctive deadrise angle that is at least two degrees larger than said hull bottom deadrise angle.

19. The deadrise-altering device of claim 14, wherein said adjunct extends behind said hull bottom surface a distance in the range between approximately three percent and approximately ten percent of said hull bottom length.

20. A method for modifying the hydrodynamic character of a marine vessel, said marine vessel having a rigid V-angular hull bottom characterized by a deadrise angle, a hull bottom length, and a hull bottom width, the method comprising:

providing an adjunct for said marine vessel, said adjunct being made entirely of a rigid and noncompressible material and being characterized by a shape capable of resisting deformation, said adjunct including a V-angular upper adjunct surface and a V-angular lower adjunct surface, said upper adjunct surface being characterized by an upper surface angularity that is equal to said deadrise angle, said lower adjunct surface being characterized by a lower surface angularity that is unequal to said deadrise angle; and converting said hull bottom to a different said hull bottom, the different said hull bottom being characterized by a different said deadrise angle and thereby imparting a substantially different hydrodynamic character, said converting including mounting said adjunct onto said hull bottom so that said upper adjunct surface is continuously maintained flush with said hull bottom and said lower adjunct surface faces generally downward, said mounted adjunct being coextensive with at least approximately half of said hull bottom length and at least in part being coextensive with approximately all of said hull bottom width for at least approximately half of said hull bottom length.

21. The method for modifying of claim 20, wherein said lower adjunct surface is characterized by said lower surface angularity that is at least one degree higher or lower than said deadrise angle.

22. The method for modifying of claim 20, wherein said mounted adjunct is coextensive with approximately all of said hull bottom length.

23. The method for modifying of claim 20, wherein said hull bottom is characterized by said deadrise angle that is constant along said hull bottom length, and wherein the different said hull bottom is characterized by plural stations along said hull bottom length, said lower surface angularity varying between adjacent said stations, the different said hull bottom thereby being characterized by a different said deadrise angle that is variable along said hull bottom length.

* * * * *